US009289815B2

(12) United States Patent
Breen et al.

(10) Patent No.: US 9,289,815 B2
(45) Date of Patent: Mar. 22, 2016

(54) MODULAR PILOT ASSEMBLY WITH SELF-CONTAINED STRIPPER AND METHOD FOR METAL FORMING DIES

(75) Inventors: Scott M. Breen, Marne, MI (US); Joel T. Pyper, Grand Rapids, MI (US)

(73) Assignee: Standard Lifters, Inc., Grand Rapids, MI (US)

( * ) Notice: Subject to any disclaimer, the term of this patent is extended or adjusted under 35 U.S.C. 154(b) by 888 days.

(21) Appl. No.: 13/545,226

(22) Filed: Jul. 10, 2012

(65) Prior Publication Data

US 2013/0167612 A1 Jul. 4, 2013

Related U.S. Application Data

(60) Provisional application No. 61/581,311, filed on Dec. 29, 2011.

(51) Int. Cl.
*B21D 37/08* (2006.01)
*B21D 43/06* (2006.01)
*B21K 27/04* (2006.01)

(52) U.S. Cl.
CPC ..... *B21D 37/08* (2013.01); *B21D 43/06* (2013.01); *B21K 27/04* (2013.01)

(58) Field of Classification Search
CPC ..... B21D 43/05; B21D 43/04; B21D 37/08; B21D 45/05; B21D 45/04; B21D 45/006; B21D 45/00; B21D 45/003; B21D 45/02; B21D 45/06; B21D 45/10
See application file for complete search history.

(56) References Cited

U.S. PATENT DOCUMENTS

| | | | | |
|---|---|---|---|---|
| 2,168,377 | A * | 8/1939 | Wales | B21D 45/006 83/140 |
| 3,336,627 | A * | 8/1967 | Nemoede | A01C 15/16 222/613 |
| 4,342,214 | A | 8/1982 | Neuendorf | |
| 4,457,196 | A * | 7/1984 | Cady | B21D 45/006 83/140 |
| 4,644,836 | A | 2/1987 | Wepner | |

(Continued)

FOREIGN PATENT DOCUMENTS

| | | |
|---|---|---|
| JP | 56084130 | 9/1981 |
| JP | 56122634 | 9/1981 |

(Continued)

OTHER PUBLICATIONS

Standard Lifters Inc., "Pilot Assembly," sales brochure, publication date Oct. 2011, 15 pages total, Grand Rapids, Michigan, USA.

(Continued)

*Primary Examiner* — Shelley Self
*Assistant Examiner* — Pradeep C Battula
(74) *Attorney, Agent, or Firm* — Price Heneveld LLP

(57) ABSTRACT

A pilot assembly and method has a cylindrical pilot sleeve with an apertured outer end in which a separate pilot pin is received, a grooved inner end, and a central portion with at least one inwardly curved sidewall relief, as well as internally mounted reciprocating ejector pins with outer ends that protrude through holes in the outer body end to strip stock from the pilot pin. A spring has its outer end mounted in the sleeve groove, and an inner end captured in a die pocket in a pre-tensed condition. A mounting screw has an enlarged head that has at least a portion thereof fit into the pilot sidewall relief, and a threaded shank that anchors the pilot sleeve in the die.

39 Claims, 6 Drawing Sheets

(56) References Cited

U.S. PATENT DOCUMENTS

| | | | | |
|---|---|---|---|---|
| 4,916,931 | A | 4/1990 | Kaeseler | |
| 4,993,295 | A * | 2/1991 | Dacey, Jr. | B21D 45/006 83/140 |
| 5,860,315 | A | 1/1999 | Sawdon | |
| 8,844,335 | B2 * | 9/2014 | Pyper | B21D 43/06 72/405.06 |
| 8,950,233 | B2 * | 2/2015 | Pyper | B21D 43/003 72/344 |
| 8,955,364 | B2 * | 2/2015 | Breen | B21D 28/34 72/344 |
| 9,138,799 | B2 * | 9/2015 | Breen | B21D 43/06 |
| 2013/0167612 | A1 * | 7/2013 | Breen | B21D 43/06 72/404 |

FOREIGN PATENT DOCUMENTS

| | | |
|---|---|---|
| JP | 57100825 | 6/1982 |
| JP | 06142788 | 5/1994 |
| KR | 1020010069897 | 7/2001 |
| KR | 102006104028 | 10/2006 |
| KR | 100766072 | 10/2007 |

OTHER PUBLICATIONS

Standard Lifters Inc., "Pilot Sleeve," sales brochure, publication date Jan. 2012, 18 pages total, Grand Rapids, Michigan, USA.

Fibro Inc., "Pilot Units to Daimler Standard," catalog, p. E72, publication date unknown, 1 page total, Rockford, Illinois, USA.

Dayton Progress Corporation, "Regular Pilots," catalog, pp. 9, 11 and 13, publication date unknown, 3 pages total, Dayton, Ohio, USA.

Ajacs Die Sales Corporation, "Pilot Retainer," sales brochure, publication date unknown, 2 pages total, Grand Rapids, Michigan, USA.

Misumi Corporation, "Pilot Punches," catalog, pp. 202, 220, 228, 234, 242, 946 and 948, publication date unknown, 7 pages total, Schaumburg, Illinois, USA.

Modern Die Systems Inc., "Die Accessories," sales brochure, publication date unknown, 1 page total, Ellwood, Indiana, USA.

* cited by examiner

MODULAR PILOT ASSEMBLY WITH SELF-CONTAINED STRIPPER AND METHOD FOR METAL FORMING DIES

CROSS REFERENCE TO RELATED APPLICATIONS AND CLAIM TO PRIORITY

The present application is related to commonly assigned, U.S. provisional patent application Ser. No. 61/581,311, filed Dec. 29, 2011, entitled PILOT SLEEVE AND METHOD FOR METAL FORMING DIES AND THE LIKE, which is incorporated herein by reference, and claims priority thereto under 35 U.S.C. §119, as well as U.S. Pat. No. 9,138,799 titled "MODULAR PILOT ASSEMBLY WITH SELF-CONTAINED STRIPPER AND METHOD FOR METAL FORMING DIES," filed even date herewith, entitled MODULAR PILOT ASSEMBLY WITH SELF-CONTAINED STRIPPER AND METHOD, which is also incorporated herein by reference.

BACKGROUND OF THE INVENTION

The present invention relates to metal forming dies and the like, and in particular to a modular pilot assembly with self-contained stripper and associated method.

Metal forming dies, such as stamping dies and the like, are well known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming processes have typically been individually designed, one of a kind assemblies for a particular part, with each of the various components being handcrafted and custom mounted or fitted in an associated die set, which is in turn positioned in a stamping press. Not only are the punches and the other forming tools in the die set individually designed and constructed, but the other parts of the die set, such as stock lifters, guides, end caps and keepers, cam returns, pilots, etc. are also custom designed, and installed in the die set. Current die making processes require carefully machined, precision holes and recesses in the die set for mounting the individual components, such that the same are quite labor intensive, and require substantial lead time to make, test and set up in a stamping press. Consequently, such metal forming dies are very expensive to design, manufacture, and repair or modify.

Pilot assemblies, such as that disclosed in U.S. Pat. No. 4,342,214, are used for locating a work piece in successive forming stages of a machine, such as a punch press, where the work piece is progressively moved through the forming stages of the machine. The pilot assembly typically includes a pilot pin mounted to a movable die member of the machine for guiding entry into a previously formed hole in a work piece or in a companion die member as the die members are moved toward each other.

FIGS. 5-8 illustrate several well known prior art metal forming dies and associated pilot mechanisms, which further represent the background of the present invention. For example, FIG. 5 illustrates one half of a die set 100, which includes a first die member 101 having a plurality of longitudinally spaced apart work stations 102 at which various bending, forming, cut-off and/or punching operations are performed on an elongate strip of metal stock 103. As best illustrated in FIG. 6, the prior art pilot mechanism 104 for the illustrated die set 100 includes a pierce tool punch 105 located at an upstream portion of stock strip 103, which, in the illustrated example, forms a vertically oriented through hole 106 in the stock strip 103 at regularly spaced apart intervals along the stock strip. The through holes or pilot holes 106 are selectively engaged by a series of pilot pins 107 positioned on at least selected ones of the die work stations 102, which serve to precisely locate the stock strip 103 in the work stations, and retain the same in place during the metal forming stroke of the die tools. After each metal forming stroke of the die tools, the pilot pins 107 are retracted out of their associated pilot holes 106 in the stock strip 103, and the stock strip is then shifted longitudinally to the next adjacent work station 102, until the metal part has been completely formed and cut off of the stock strip. When the pilot pins 107 are retracted out of the pilot holes 106 in the stock strip 103, the stock strip tends to stick on one or more of the pilot pins, thereby requiring some type of stripper mechanism to separate them, such that the stock strip can be quickly and sequentially advanced longitudinally through the various die stations.

FIG. 7 illustrates another known prior art pilot assembly that includes a rectangularly shaped block or base 111 that is mounted in a blind hole pocket 112 in an associated upper die member 113. The base block 111 includes a central aperture 114 in which a pilot pin 115 is retained, and two laterally offset reaction apertures 116 in which a pair of stripper assemblies are received and retained. A female punch tool 117 is positioned in the lower die member 122, and closely receives the pilot pin 115 to precisely locate the stock strip 5 in the associated work station 112. Each of the stripper assemblies comprises a plunger shaped rod 118 having an outer end 119 protruding outwardly from base block 111 toward the stock strip 103, and an inner end 120 with a coil spring 121 received thereover which resiliently urges the rods 118 outwardly on opposite sides of pilot pin 15, and serve to strip the stock strip 103 from the exterior surface of the pilot pin 115 as the pilot pin and associated upper die member 113 are raised to a diverged condition relative to the lower die member 122.

FIG. 8 illustrates yet another known prior art pilot assembly, which includes an enlarged, flat mounting plate 126 which attaches to the upper surface 127 of the upper die member 113 using a pair of cap head screws 128 having threaded shanks 129 that are anchored in the upper die member 113. The upper die member 113 includes a central aperture 114 in which a pilot pin 115 is received and retained, along with a pair of reaction apertures 116 disposed on opposite sides of pilot pin 115, each of which receives and retains therein a plunger shaped rod 118. The outer ends 119 of the rods 118 protrude outwardly from the lower surface of upper die member 113, while the inner ends 120 of rods 118 have coil springs 121 received thereon which resiliently urge rods 118 outwardly, such that the outer ends 119 of rods 118 serve to strip the stock strip 5 away from the exterior surface of the pilot pin 115, and thereby permit the stock strip 5 to be shifted longitudinally into the next adjacent work station.

Large manufacturers of formed metal parts, such as those which supply parts to automobile companies and the like, have an extensive inventory of metal forming dies and related metal handling machinery. Through the years, such companies have standardized on several different styles and sizes of pilot punches and associated pins for use with their various dies, so as to maximize efficiencies when combining various tooling for a specific project. Similarly, the metal forming die industry generally has adopted such standard pilot punch and pin sizes and shapes to minimize the effort and expense of making, installing and maintaining the dies and related metal handling equipment. When a new die is designed and fabricated by a tool and die maker, the customer will often specify that the die maker use a specific shape and size of pilot punching pin, which is often one of several styles that are standard or non-custom, and are commercially readily available. Sometimes, the customer will actually provide to the die maker the pilot punch and pilot pins that it desires to be incorporated into a specific progressive metal forming die, or portion thereof.

While such prior pilot assemblies have proven generally successful, they are rather expensive and time consuming to construct and install in an associated die set, such that further improvements and enhancements to the same, as well as metal forming dies generally, would be clearly advantageous, and are disclosed herein.

SUMMARY OF THE INVENTION

One aspect of the present invention is a multi-station progressive metal forming die, having at least two mutually converging and diverging die members between which an elongate stock strip is shifted longitudinally to form parts from the stock strip, along with an improved modular pilot assembly with self-contained stripper. The modular pilot assembly includes a pilot sleeve operably supported on one of the die members, and having a generally cylindrical shape with an outer end portion oriented toward the stock strip, an oppositely disposed inner end portion oriented away from the stock strip, and a central aperture extending through the outer and inner end portions. The outer end portion of the pilot sleeve has a generally flat outer end oriented toward the stock strip, a generally recessed inner end oriented away from the stock strip, and an outer sidewall with at least one fastener relief therein having an arcuately shaped, radially inwardly curved relief sidewall that extends axially from the flat outer end to a generally flat, arcuately shaped relief end surface facing toward the stock strip and spaced axially outwardly a predetermined distance from the recessed inner end, as well as at least one axially extending ejector pin aperture which opens through the flat outer end and into the recessed inner end. The inner end portion of the pilot sleeve has a generally annularly shaped spring retainer collar, with an outer end oriented toward the stock strip, an inner end oriented away from the stock strip, and an outer sidewall with a diameter that is less than the diameter of the outer sidewall of the outer end portion of the pilot sleeve, thereby forming an annularly shaped spring groove adjacent the outer end of the spring retainer collar. The modular pilot assembly also includes a rigid pilot pin, having a portion thereof shaped for close reception in the central aperture of the pilot sleeve in an assembled condition, and including a circularly shaped innermost collar portion disposed adjacent the flat outer end of the pilot sleeve and shaped for close reception in a pilot hole in the stock strip, a generally frusto-conically shaped outer portion configured to engage the pilot hole in a stock strip and guide the stock strip to a predetermined position in an associated die forming station, and a base portion positioned opposite the frusto-conically shaped outer portion. The modular die assembly also includes at least one rigid ejector pin slidingly received and retained in the ejector pin aperture in the outer end portion of the pilot sleeve having an inner end oriented away from the stock strip and an outer end oriented toward the stock strip and protruding outwardly from the flat outer end of the outer end portion of the pilot sleeve when urged to an extended position to contact the stock strip and strip the same away from the pilot pin, and retracts towards the pilot sleeve when urged to a retracted position. The modular pilot assembly also includes a spring member having a generally hollow interior that is received onto and over the spring retainer collar on the inner end portion of the pilot sleeve, an outer end oriented toward the stock strip, received in the spring groove and operably engaging the inner end of the ejector pin to bias the ejector pin outwardly to the extended position, and an inner end oriented away from the stock strip and positioned adjacent to the base portion of the pilot pin in the assembled condition. The modular pilot assembly also includes a mounting screw having an enlarged head portion with a circular plan shape that is at least partially, closely received in the fastener relief in the outer end portion of the pilot sleeve, an annularly shaped inner face oriented away from the stock strip and abuttingly engaging the relief end surface of the fastener relief in the outer end portion of the pilot sleeve, and a threaded shank portion anchored in the one die member to securely, yet detachably mount the modular pilot assembly on the one die member in a manner which causes the ejector pin to automatically reciprocate between the retracted and extended positions relative to the pilot sleeve during operation of the metal forming die to ensure that the stock strip is consistently stripped away from the pilot pin.

Yet another aspect of the present invention is a modular pilot assembly with self-contained stripper for multi-station progressive metal forming dies having at least two mutually converging and diverging die members between which an elongate stock strip is shifted longitudinally to form parts from the stock strip. The pilot assembly includes a pilot sleeve configured for operable support on an associated die member, and having a generally cylindrical shape with an outer end portion oriented toward the stock strip, and oppositely disposed inner end portion oriented away from the stock strip, and a central aperture extending through the outer and inner end portions. The outer end portion of the pilot sleeve has a generally flat outer end oriented toward the stock strip, a generally recessed inner end oriented away from the stock strip, and an outer sidewall with at least one fastener relief therein having an arcuately shaped, radially inwardly curved relief sidewall that extends axially from the flat outer end face to a generally flat arcuately shaped relief end surface facing toward the stock strip and spaced axially outwardly a predetermined distance from the recessed inner end, as well as at least one axially extending ejector pin aperture which opens through the flat outer end and into the recessed inner end. The inner end portion of the pilot sleeve has a generally annularly shaped spring retainer collar, with an outer end oriented toward the stock strip, an inner end oriented away from the stock strip, and an outer sidewall with a diameter that is less than the diameter of the outer sidewall of the outer end portion of the pilot sleeve, thereby forming an annulary shaped spring groove adjacent the outer end of the spring retainer collar. The pilot assembly also includes a rigid pilot pin having at least a portion thereof shaped for close reception in the central aperture of the pilot sleeve in an assembled condition, and including a circularly shaped innermost collar portion disposed adjacent the flat outer end of the pilot sleeve and shaped for close reception in a pilot hole in the stock strip, a generally frusto-conically shaped outer portion configured to engage the pilot hole in the stock strip and guide the stock strip to a predetermined position in an associated die forming station, and a base portion positioned opposite the frusto-conically shaped outer portion. The pilot assembly also has at least one rigid ejector pin slidingly received and retained in the ejector pin aperture in the outer end portion of the pilot sleeve, having an inner end oriented away from the stock strip, and an outer end oriented toward the stock strip and protruding outwardly from the flat outer end of the outer end portion of the pilot sleeve when urged to an extended position to contact the stock strip and strip the same away from the pilot pin, and retracts toward the outer end portion of the pilot sleeve when urged to a retracted position. The pilot assembly also includes a spring member having a generally hollow interior that is received onto and over the spring retainer collar on the inner end portion of the pilot sleeve, an outer end oriented toward the stock strip, received in the spring groove and operably engaging the inner end of the ejector pin to bias the ejector pin outwardly to the extended position, and an inner end oriented away from the stock strip and positioned adjacent to the base portion of the pilot pin in the assembled condition. The pilot assembly also includes a mounting screw having an enlarged head portion, with a circular plan shape that is at least partially, closely received in the fastener relief in the outer end portion of the pilot sleeve, an annularly shaped inner face oriented away from the stock strip and abuttingly engaging the relief end surface of the fastener relief in the outer end portion of the pilot sleeve, and a threaded shank portion shaped for anchoring in the associated die member, to securely, yet detachably mount the pilot assembly on the associated die member in a manner which causes the ejector pin to automatically reciprocate between the retracted and extended positions relative to the pilot sleeve during operation of the metal forming die to insure that the stock strip is consistently stripped away from the pilot pin.

Yet another aspect of the present invention is a modular pilot sleeve assembly with self-contained stripper for multi-station progressive metal forming dies, having at least two mutually converging and diverging die members between which an elongate stock strip is shifted longitudinally to form parts from the stock strip, and at least one pilot pin to precisely locate the stock strip in the die stations. The pilot sleeve assembly includes a pilot sleeve configured for operable support on an associated die member, and having a generally cylindrical shape, with an outer end portion oriented toward the stock strip, and oppositely disposed inner end portion oriented away from the stock strip, and a central aperture extending through the outer end portion shaped to closely receive and selectively receive the pilot pin therein. The outer end portion of the pilot sleeve has a generally flat outer end oriented toward the stock strip, a generally recessed inner end oriented away from the stock strip, and an outer sidewall with at least one fastener relief therein having an arcuately shaped, radially inwardly curved relief sidewall that extends axially from the flat outer end face to a generally flat arcuately shaped end surface facing toward the stock strip and spaced axially outwardly a predetermined distance from the recessed inner end, as well as at least one axially extending ejector pin aperture which opens though the flat outer end and into the recessed inner end. The inner end portion of the pilot sleeve has a generally annularly shaped spring retainer collar, with an outer end oriented toward the stock strip, an inner end oriented away from the stock strip, and an outer sidewall with a diameter that is less than the diameter of the outer sidewall of the outer end portion of the pilot sleeve, thereby forming an annularly shaped spring groove adjacent the outer end of the spring retainer collar. The pilot assembly has at least one rigid ejector pin slidingly received and retained in the ejector pin aperture in the outer end portion of the pilot sleeve, having an inner end oriented away from the stock strip and an outer end oriented toward the stock strip and protruding outwardly from the flat outer end of the outer end portion of the pilot sleeve when urged to an extended position to contact the stock strip and strip the same away from the pilot pin, and retracts toward the pilot sleeve when urged to a retracted position. The pilot assembly also includes a spring member having a generally hollow interior that is received onto and over the spring retainer collar on the inner end portion of the pilot sleeve, an outer end oriented toward the stock strip, received in the spring groove and operably engaging the inner end of the ejector pin to bias the ejector pin outwardly to the extended position, and an inner end oriented away from the stock strip and positioned adjacent to the inner end of the spring retainer collar in the assembled condition. The pilot assembly also includes a mounting screw having an enlarged head portion with a circular plan shape that is at least partially, closely received in the fastener relief in the outer end portion of the pilot sleeve, an annularly shaped inner face oriented away from the stock strip and abuttingly engaging the relief end surface of the fastener relief in the outer end portion of the pilot sleeve, and a threaded shank portion shaped for anchoring in the associated die member to securely, yet detachably mount the pilot assembly on the associated die member in a manner which causes the ejector pin to automatically reciprocate between the retracted and extended positions relative to the pilot sleeve during operation of the metal forming die to ensure that the stock strip is consistently stripped away from the pilot pin.

Yet another aspect of the present invention is a method for making a multi-station progressive metal forming die having at least two mutually converging and diverging die members between which an elongate stock strip is shifted longitudinally to form parts from the stock strip, with the improvement of at least one modular pilot with self-contained stripper for precisely locating the stock strip in the die stations. The method includes forming a pilot sleeve for operable support on one of the die members, with a generally cylindrical shape having an outer end portion oriented toward the stock strip, and oppositely disposed inner end portion oriented away from the stock strip, and a central aperture extending through the outer and inner end portions. The method also includes forming the outer end portion of the pilot sleeve with a generally flat outer end oriented toward the stock strip, a generally recessed inner end oriented away from the stock strip, and an outer sidewall with at least one fastener relief therein having an arcuately shaped, radially inwardly curved relief sidewall that extends axially from the flat outer end to a generally flat arcuately shaped relief end surface facing toward the stock strip and spaced axially outwardly a predetermined distance from the recessed inner end, as well as at least one axially extending ejector pin aperture which opens through the flat outer end and into the recessed inner end. The method also includes forming the inner end portion of the pilot sleeve with a generally annularly shaped spring retainer collar, having an outer end oriented toward the stock strip, an inner end oriented away from the stock strip, and an outer sidewall with a diameter that is less than the diameter of the outer sidewall of the outer end portion of the pilot sleeve, thereby forming an annularly shaped spring groove adjacent the outer end of the spring retainer collar. The method also includes forming at least one rigid ejector pin with an inner end, and an outer end configured to protrude outwardly from the flat outer end of the outer end portion of the pilot sleeve when urged to an extended position to contact the stock strip, and to retract toward the pilot sleeve when urged to a retracted position. The method further includes inserting the ejector pin into the ejector pin aperture in the body portion of the pilot, such that the ejector pin is slidingly received and retained in the ejector pin aperture for longitudinal reciprocation therein between the extended and retracted positions. The method also includes selecting a spring member with a generally hollow interior, an outer end oriented toward the stock strip, and an opposite inner end oriented away from the stock strip. The method further includes positioning the hollow interior of the spring member onto and over the spring retainer collar on the inner end portion of the pilot sleeve, with the outer end of the spring member received in the spring groove, and abutting the inner end of the ejector pin, and the inner end of the spring member protruding inwardly away from the outer end portion of the pilot sleeve in a pre-assembled condition. The method also includes providing a pilot pin with a medial portion shaped for close reception in the central aperture of the pilot sleeve in an assembled condition, a tapered outer portion configured to engage the pilot hole in the stock strip and guide the stock strip to a predetermined position or centered condition in an associated one of the die forming stations, and an inner face portion position opposite the tapered outer portion. The method also includes inserting the pilot pin into the central aperture of the pilot sleeve, such that the tapered outer portion of the pilot pin protrudes outwardly from the flat outer end of the outer end portion of the pilot sleeve to define an assembled condition. The method also includes forming a non-threaded blind hole pocket in the mounting face of one of the die members, with a cylindrical sidewall shaped to closely receive and retain at least a portion of the outer end portion of the pilot sleeve therein. The method also includes forming a threaded mounting screw aperture in the mounting face of the one die member, at a location spaced laterally apart from the pilot pocket a predetermined distance. The method also includes inserting the pilot sleeve in the assembled condition into the pilot pocket in the one die member with at least the outer sidewall of the outer end portion of the pilot sleeve closely received and retained therein so as to accurately locate the pilot assembly on the one die member, and with the fastener relief in the body portion of the pilot sleeve facing and aligned with the mounting screw aperture in the one die member. The method further includes selecting a mounting screw having an enlarged head portion with a circular plan shape sized for close reception of at least a portion thereof in the fastener relief in the body portion of the pilot sleeve, an annularly shaped inner face sized for abutment with at least a portion of the relief end surface of the fastener relief in the body portion of the pilot, and a threaded shank portion. The method also includes inserting the threaded shank portion of the mounting screw axially into the mounting screw aperture in the mounting face of the one die member, such that at least a portion of the enlarged head portion of the mounting screw is closely received in the fastener relief and adjacent the relief sidewall on the outer end portion of the pilot sleeve. The method also includes tightening the mounting screw in the mounting screw aperture in the one die member, thereby abuttingly engaging the inner face of the mounting screw head portion securely against the relief end surface of the fastener relief in the outer end portion of the pilot sleeve to securely, yet detachably, mount the pilot assembly on the one die member in a manner which causes the ejector pin to automatically reciprocate between the retracted and extended positions relative to the pilot sleeve during operation of the metal forming die to insure that the stock strip is consistently stripped away from the pilot pin.

Yet another aspect of the present invention is a pilot assembly that can be easily installed in an associated die member by simple machining a single pocket and a single tapped retainer hole therein. The pilot assembly has a self-contained stripper with no loose pieces or parts, is constructed from fewer components than prior art pilot devices and positively prevents the stock strip from sticking to the pilot pin. The pilot assembly includes a pilot sleeve with a central aperture configured to receive and retain therein one of a plurality of differently sized and shaped, conventional, and/or commercially available, pilot pins to facilitate the use of common parts throughout the metal forming die. The body portion of the pilot sleeve itself provides the precise location of the stripper assembly in an associated die pad at a location close to the stock strip. The stripper assembly has a modular design that can be economically manufactured, has a small profile and footprint, and can be easily assembled and disassembled from an associated die member. Due to the design of the pilot assembly, the ejector pins can be located in close proximity to the pilot pin, so as to positively and dependably, repeatedly strip the stock strip from the pilot pin. The pilot assembly has a single screw mounting system for quick and easy installation in an associated die member. The pilot sleeve can be machined from a single piece of solid material in one setup to achieve tighter tolerances and better concentricity between the pilot sleeve and pilot pin, as well as reduced manufacturing cost. The pilot assembly is efficient in use, economical to manufacture, capable of the long operating life, and particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
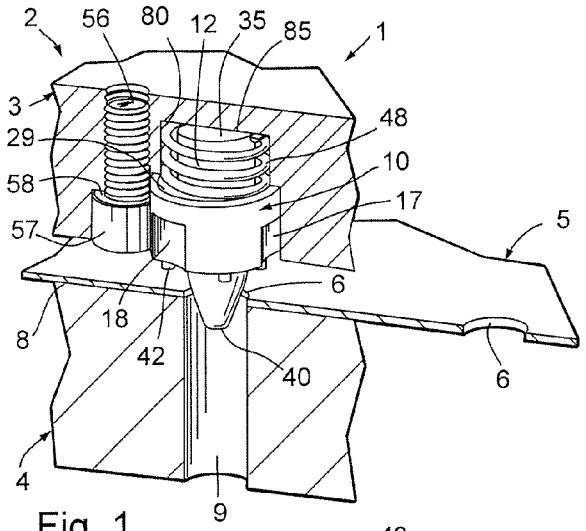
FIG. 1 is a perspective view of a modular pilot assembly with self-contained stripper embodying the present invention, shown installed in a die set carrying a stock strip in which pilot holes have been formed.
Figure 3:
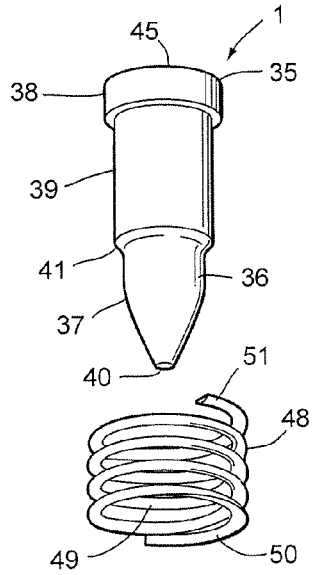
FIG. 3 is a perspective view of a portion of the pilot assembly in an assembled condition, taken from an outer end thereof.
Figure 3:
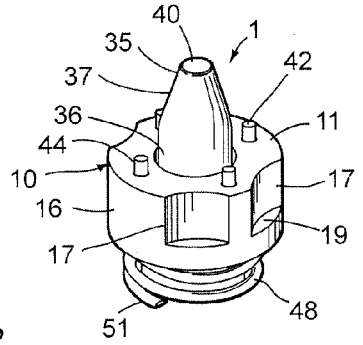
Figure 3A:
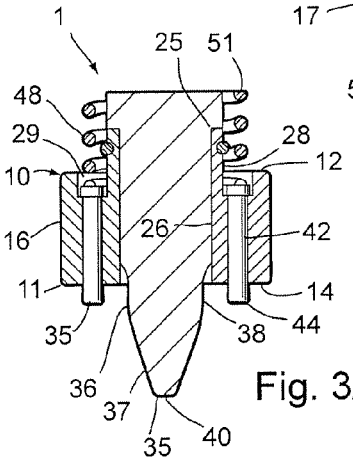
FIG. 3A is a vertical cross-sectional view of the portion of the pilot assembly shown in FIG. 3.
Figure 2:
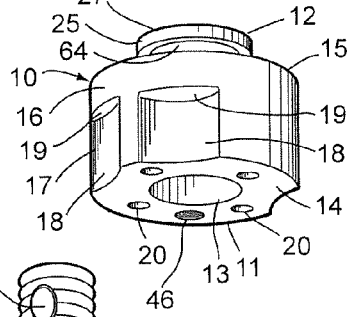
FIG. 2 is an exploded perspective view of the pilot assembly shown in FIG. 1.
Figure 2:
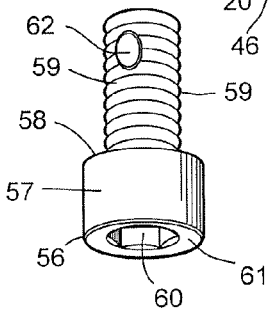

For purposes of description herein, the terms "upper," "lower," "right," "left," "rear," "front," "vertical," "horizontal" and derivatives thereof shall relate to the invention as oriented in FIGS. 1, 2 and 3A. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIGS. 1-4) generally designates a modular pilot assembly with self-contained stripper embodying the present invention. As shown in FIG. 1, the pilot assembly 1 is particularly adapted for use in conjunction with a multi-station progressive metal forming die 2, having at least two mutually converging and diverging die members 3 and 4, between which an elongate stock strip 5 is shifted longitudinally to form parts from the stock strip. The pilot assembly 1 includes a pilot sleeve 10 operably supported on one of the two die members 3, 4 and having a generally cylindrical shape with an outer end portion 11 oriented toward the stock strip 5, an oppositely disposed inner end portion 12 oriented away from the stock strip 5, and a central aperture 13 extending through the outer and inner end portions 11, 12. The outer end portion 11 of the pilot sleeve 10 has a generally flat outer end 14 oriented toward the stock strip 5, a generally recessed inner end 15 oriented away from the stock strip 5, and an outer sidewall 16 with at least one fastener relief 17 therein having an arcuately shaped, radially inwardly curved relief sidewall 18 that extends axially from the flat outer end 14 to a generally flat, arcuately shaped relief end surface 19 facing toward the stock strip 5 and spaced axially outwardly a predetermined distance from the recessed inner end 15. The outer end portion 11 of pilot sleeve 10 also includes at least one axially extending ejector pin aperture 20 which opens through the flat outer end 14 and into the recessed inner end 15. The inner end portion 12 of the pilot sleeve 10 has a generally annularly shaped spring retainer collar 25, with an outer end 26 oriented toward the stock strip 5, an inner end 27 oriented away from the stock strip 5, and an outer sidewall 28 with a diameter that is less than the diameter of the outer sidewall 16 of the outer end portion 11 of the pilot sleeve 10, thereby forming an annularly shaped spring groove 29 adjacent the outer end 26 of the spring retainer collar 25. The pilot assembly 1 also includes a rigid pilot pin 35 having at least a portion thereof shaped for close reception in the central aperture 13 of the pilot sleeve 10 in an assembled condition. Pilot pin 35 includes a circularly shaped innermost collar portion 36 disposed adjacent the flat outer end 14 of the pilot sleeve 10 in the assembled condition shown in FIGS. 3 and 3A, and shaped for close reception in a pilot hole 6 in the stock strip 5, a generally frusto-conically shaped outer portion 37 configured to engage the pilot hole 6 in the stock strip 5, and guide the stock strip 5 to a predetermined position in an associated die forming station 102, and a base portion 38 positioned opposite the frusto-conically shaped outer portion 37. The pilot assembly 1 also includes at least one rigid ejector pin 42 slidingly received and retained in the ejector pin aperture 20 in the outer end portion 11 of the pilot sleeve 10, having an inner end 43 oriented away from the stock strip 5 and an outer end 44 oriented toward the stock strip 5 and protruding outwardly from the flat outer end 14 of the outer end portion 11 of the pilot sleeve 10 when urged to an extended position to contact the stock strip 5 and strip the same away from the pilot pin 35, and retracts toward the pilot sleeve 10 when urged to a retracted position. The pilot assembly 1 also includes a spring member 48 having a generally hollow interior 49 that is received onto and over the spring retainer collar 25 on the inner end portion 12 of pilot sleeve 10, an outer end 50 oriented toward the stock strip 5, which is received in the spring groove 29 and operably engages the inner end 43 of the ejector pin 42 to bias the ejector pin 42 outwardly to the extended position, and an inner end 51 oriented away from the stock strip 5 and positioned adjacent to the base portion 38 of the pilot pin 35 in the assembled condition shown in FIGS. 3 and 3A. The pilot assembly 1 also includes a mounting screw 56 having an enlarged head portion 57 with a circular plan shape that is at least partially, closely received in the fastener relief 17 in the outer end portion 11 of the pilot sleeve 10, an annularly shaped inner face 58 oriented away from the stock strip 5 and abuttingly engaging the relief end surface 19 of the fastener relief 17 in the outer end portion 11 of the pilot sleeve 10, and a threaded shank portion 59 anchored in one of the die members 3, 4 to securely, yet detachably mount the pilot assembly 1 on an associated one of the die members 3, 4 in a manner which causes the ejector pin 42 to automatically reciprocate between the retracted and extended positions relative to the pilot sleeve 10 during operation of the metal forming die to insure that the stock strip 5 is consistently fully stripped away from the pilot pin 35.

The term "die member," as used herein, refers to any portion of a metal forming die or die set, including, but not limited to, an upper die member or a die shoe, a lower die member or a die shoe, and all other die components, whether stationary or reciprocating, including a reciprocating pressure pad, or the like. In the illustrated example, the pilot assembly 1 is shown mounted in a reciprocating upper die pad 3 located above a lower stationary die shoe 4. However, as will be appreciated by those skilled in the art, pilot assembly 1 can be mounted in other types of die members and/or components in a variety of different positions and orientations, as necessary to precisely locate the stock strip 5 in the various workstations 102 of a metal forming die 100.

Figure 4:
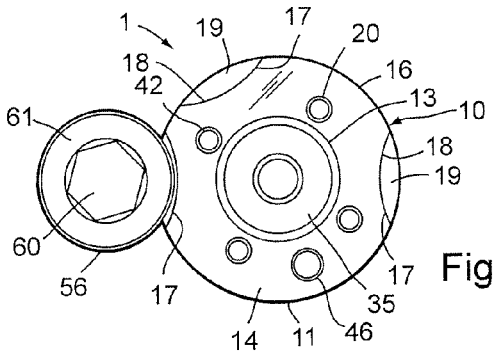
FIG. 4 is a top plan view of the pilot assembly.
Figure 5:
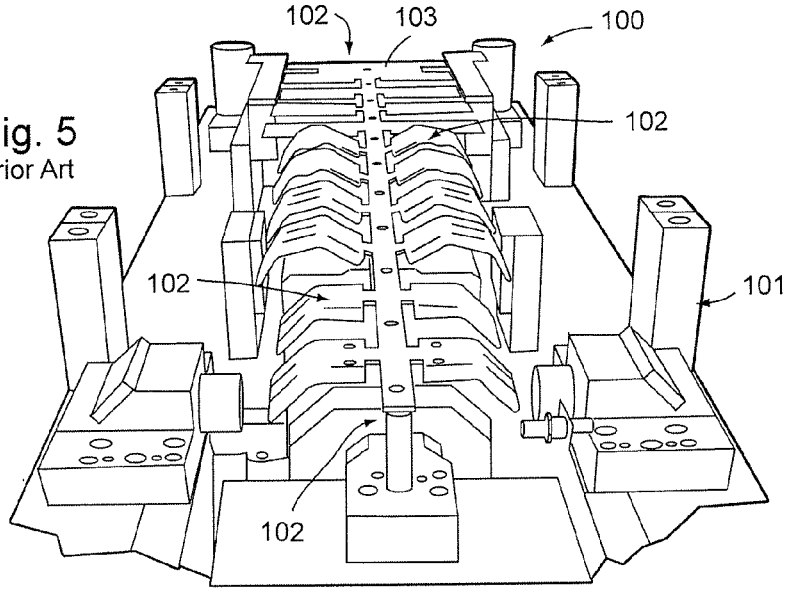
Fig. 5 Prior Art
FIG. 5 is a partially schematic perspective view of a representative, prior art die member shown in an open condition with a stock strip positioned along the various work stations of the die member.
Figure 6:
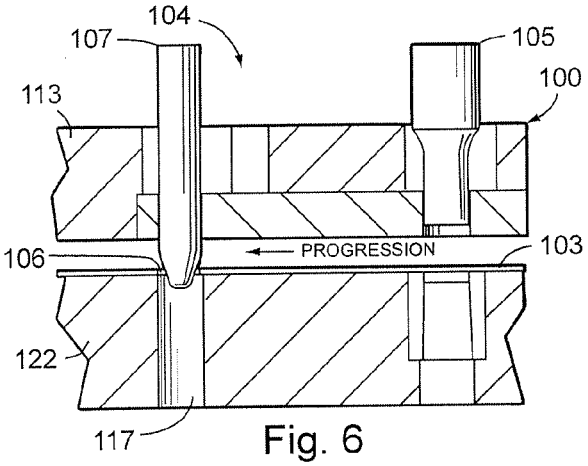
Fig. 6 Prior Art
FIG. 6 is a partially schematic cross-sectional view of a prior art pilot assembly.
Figure 7:
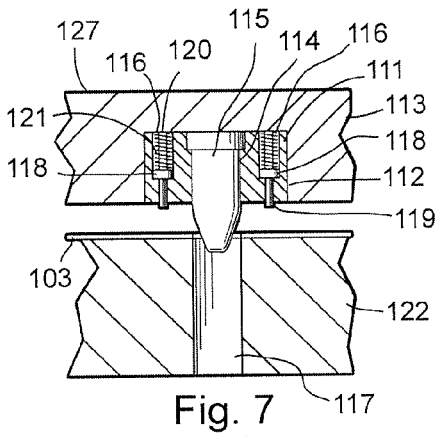
Fig. 7 Prior Art
FIG. 7 is a partially schematic cross-sectional view of another prior art pilot assembly.
Figure 8:
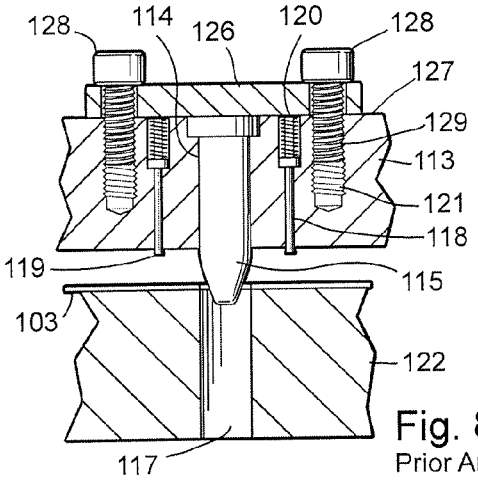
Fig. 8 Prior Art
FIG. 8 is a partially schematic cross-sectional view of yet another prior art pilot assembly.
Figure 30:
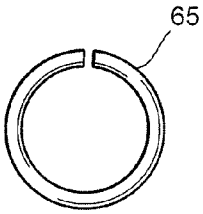
FIG. 30 is a plan view of a retainer ring portion of the pilot assembly.
Figure 31:
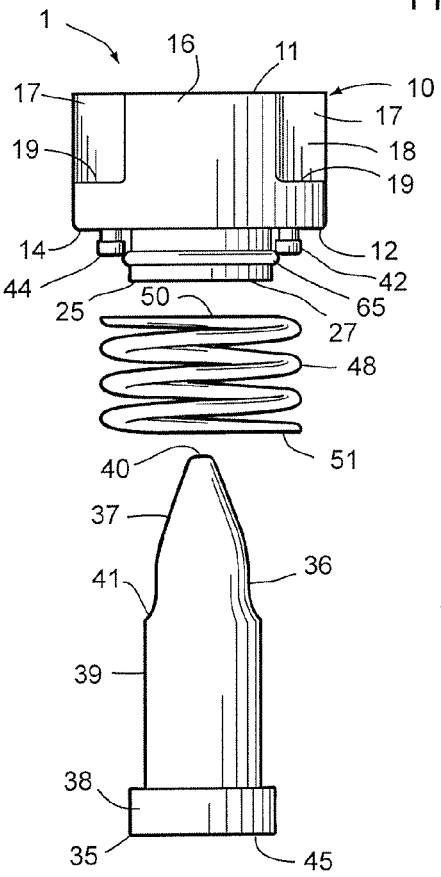
FIG. 31 is an exploded side elevational view of the pilot assembly, shown with the first pilot pin of FIG. 16 for installation therein.
Figure 33:
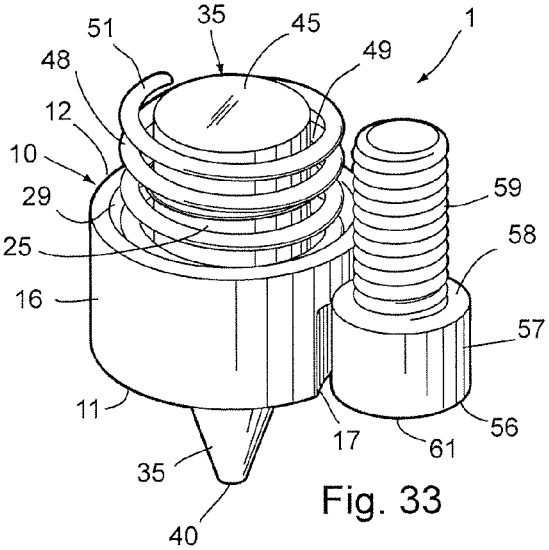
FIG. 33 is a perspective view of the pilot assembly of FIG. 31 shown in an assembled condition, from an inner end thereof.
Figure 34:
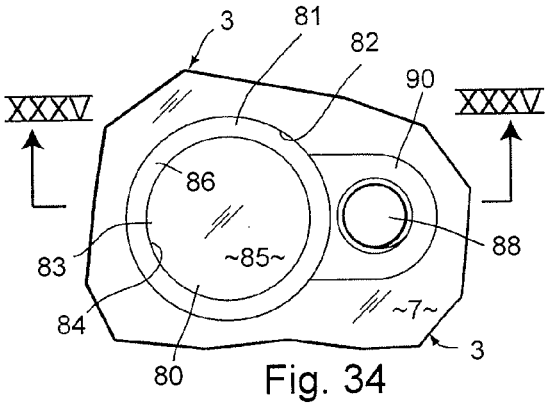
FIG. 34 is plan view of an upper pressure pad portion of a die member, that has been machined for installation of the pilot assembly therein, oriented with the normally lower mounting surface facing upwardly for illustration purposes.
Figure 35:
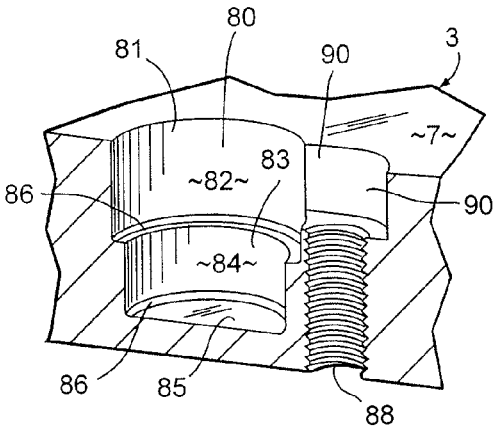
FIG. 35 is a perspective, cross-sectional view of the machined die member of FIG. 34, taken along the line XXXV-XXXV of FIG. 34.

The illustrated pilot sleeve 10 (FIGS. 10-15) has a one-piece construction formed from a solid bar of rigid material, such as metal or the like. The spring retainer collar portion 25 of the illustrated pilot sleeve 10, includes a retainer groove 64 disposed adjacent the inner end 27 of spring retainer collar 25. As best shown in FIGS. 2, 30 and 31, a retainer ring 65 is detachably retained in the retainer groove 64 in the spring retainer collar 25 and selectively abuts the inner end 43 of each ejector pin 42 to capture or retain each ejector pin 42 within the associated ejector pin aperture 20 in the outer end portion 11 of pilot sleeve 10. As discussed in greater detail below, the illustrated retainer ring comprises a conventional, split C-ring having a generally circular lateral cross-sectional shape. Furthermore, the outer end portion 11 of the illustrated pilot sleeve 10 includes a plurality of fastener reliefs 17 having a substantially identical configuration and arranged in a circumferentially spaced apart pattern around the outer sidewall 16 of the outer end portion 11 of pilot sleeve 10 to facilitate mounting the pilot assembly 1 at various hold down locations and orientations on one or more of the die members 3, 4. As best illustrated in FIG. 4, the illustrated outer sidewall 16 of pilot sleeve 10 includes three fastener reliefs 17, two of which are disposed generally diametrically opposite one another, and the third of which is oriented at an angle approximately 30°-40° from the fastener relief 17 in which the mounting screw 56 is received in the illustration of FIG. 4.

Figure 13:
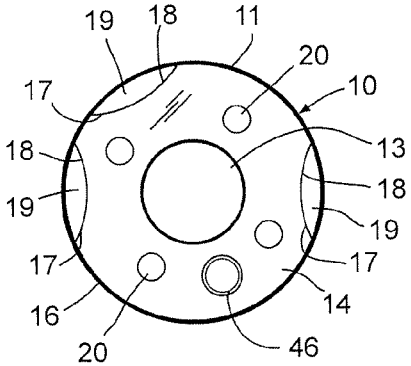
FIG. 13 is a plan view of the outer end of the pilot sleeve.
Figure 13A:
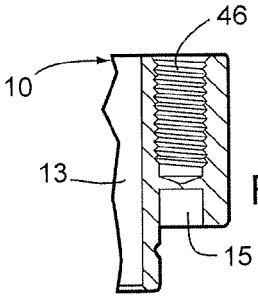
FIG. 13A is a fragmentary, vertical cross-sectional view of the pilot sleeve, showing a blind threaded puller tool aperture.
Figure 14:
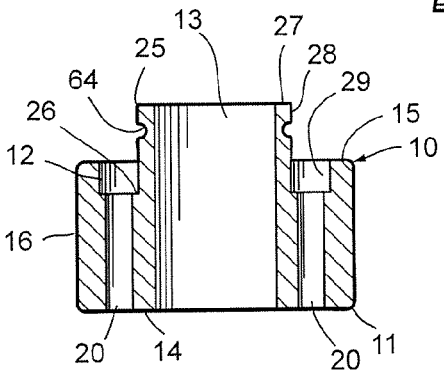
FIG. 14 is a cross-sectional view of the pilot sleeve taken along the line XIV-XIV of FIG. 10.
Figure 15:
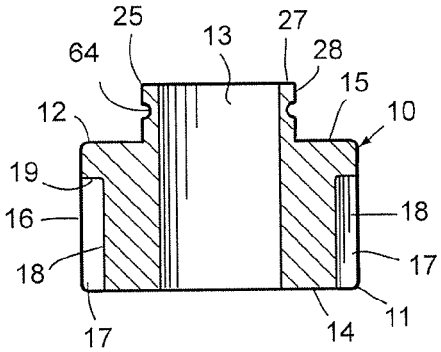
FIG. 15 is a vertical cross-sectional view of the pilot sleeve taken along with the line XV-XV of FIG. 11.
Figure 16:
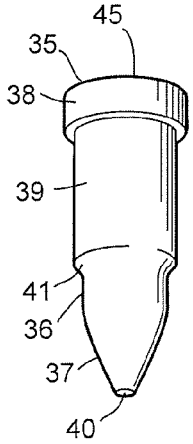
FIG. 16 is a perspective view of a first pilot pin portion of the pilot assembly.
Figure 17:
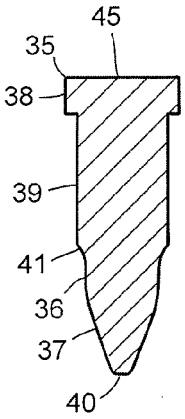
FIG. 17 is a vertical cross-sectional view of the first pilot pin shown in FIG. 16.
Figure 20:
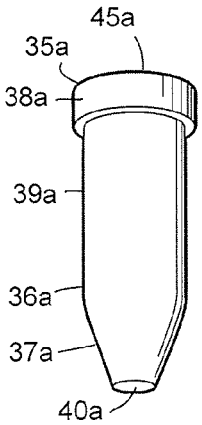
FIG. 20 is a perspective view of a second pilot pin, different from the first pilot pin of FIG. 16, which can also be used in the pilot assembly.
Figure 21:
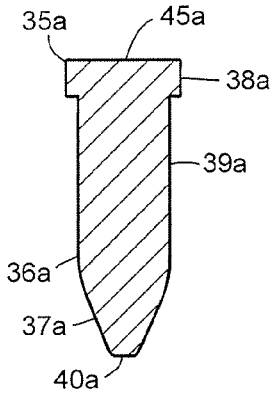
FIG. 21 is a vertical cross-sectional view of the second pilot pin shown in FIG. 20.
Figure 24:
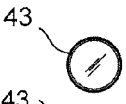
FIG. 24 is a top plan view of an ejector pin portion of the pilot assembly.
Figure 25:
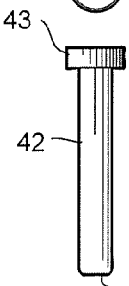
FIG. 25 is a side elevational view of the ejector pin.
Figure 26:
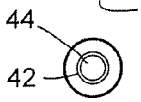
FIG. 26 is a bottom plan view of the ejector pin.
Figure 38:
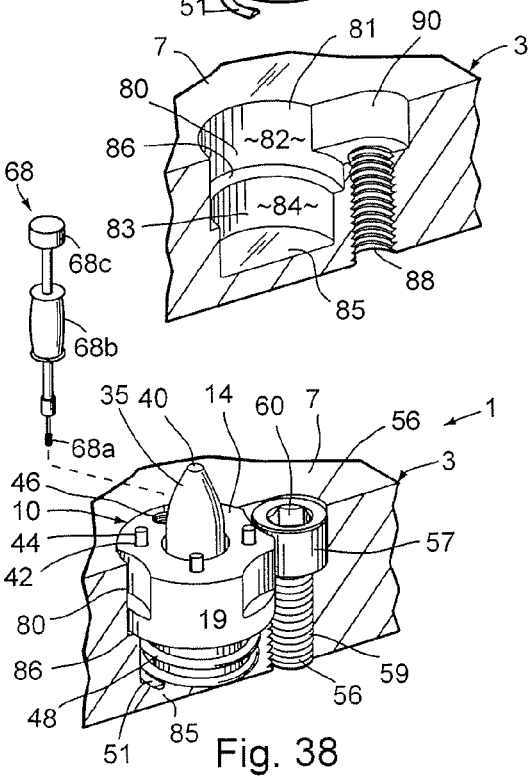
FIG. 38 is a perspective view of the pilot assembly installed in the normally lower mounting face of the upper pressure pad die member shown in FIGS. 34-37.

Since the illustrated pilot sleeve 10 has a one-piece construction formed from a solid bar of rigid material, such as metal or the like, preferably, all machining operations on the solid bar of rigid material are made during a single machine setup, so as to achieve greater accuracy and consistency of the pilot sleeve 10, as well as reduced manufacturing costs. The outer end portion 11 of the illustrated pilot sleeve 10 has a plurality of ejector pin apertures 20 having a substantially identical configuration and arranged in a circumferentially spaced apart, mutually parallel, axially extending pattern through the outer end portion 11 of pilot sleeve 10 to insure effective and consistent stripping of the stock strip 5 from the pilot pin 35. As best shown in FIGS. 4 and 11-13, the illustrated pilot sleeve 10 includes four ejector pin apertures 20 which are spaced opposite from one another on the flat outer end 14 of pilot sleeve 10, and are radially positioned close to the central aperture 13 of pilot sleeve 10, so as to improve the stripping action of the same. The illustrated pilot assembly 1 also includes four substantially identical ejector pins 42 which are slidingly received and retained for reciprocation in the ejector pin apertures 20 of the outer end portion 11 of the pilot sleeve 10. As best illustrated in FIGS. 24-26, the outer ends 44 of ejector pins 42 have a size and shape similar to the elongate body portions of ejector pins 42, each with a generally flat circular plan configuration best suited for abuttingly engaging the stock strip 5, while the inner ends 43 of ejector pins 42 are enlarged relative to the size of the elongate body portions of ejector pins 42, and define cylindrically shaped, enlarged heads, each with a generally circular, flat inner face which facilitates engagement with the outer end 50 of spring member 48. With reference to FIGS. 4, 13 and 13A, the illustrated pilot sleeve 10 includes a threaded blind installation aperture 46 which extends axially into the closed outer end 14 of the pilot sleeve 10 at a location spaced radially outwardly from and circumferentially inbetween the ejector pin apertures 20. A puller tool 68, shown schematically in FIG. 38, is configured for threaded engagement in the blind installation aperture 46 in pilot sleeve 10 to facilitate removal of the assembled pilot sleeve 10 from the associated die member 3, 4, as discussed in greater detail below. Installation aperture 46 is disposed generally opposite the three fastener reliefs 18 in pilot 1, as best shown in FIGS. 4 and 13.

Figure 18:
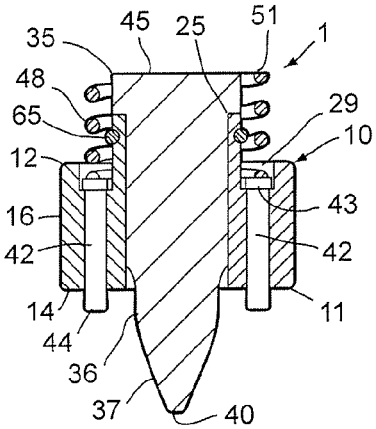
FIG. 18 is a vertical cross-sectional view of an assembled portion of the pilot assembly with the first pilot pin of FIG. 16 installed therein.
Figure 22:
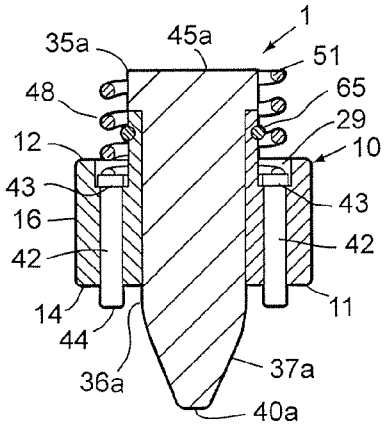
FIG. 22 is a vertical cross-sectional view of an assembled portion of the pilot assembly in which the second pilot pin of FIG. 20 is installed.
Figure 19:
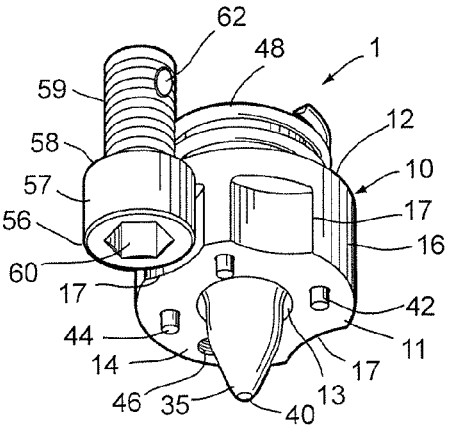
FIG. 19 is a perspective view of the pilot assembly with the first pilot pin of FIG. 16 installed therein.
Figure 23:
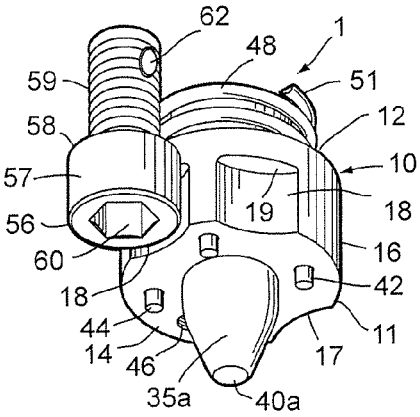
FIG. 23 is a perspective view of the pilot assembly with the second pilot pin of FIG. 20 installed therein.

As best illustrated in FIGS. 16-23, the pilot sleeve 10 is adapted to securely, yet detachably receive and retain therein one of a plurality of differently shaped and sized types of pilot pins to accommodate a wide variety of different die applications and various users. For example, the pilot pin 35 illustrated in FIGS. 16-19 is a pointed pilot and has a relatively sharply tipped bullet-like profile, wherein the base portion 38 is in the form of an enlarged circular disk that is integrally formed with a cylindrical or a barrel-shaped medial portion 39, with a frusto-conical outer portion 37 that tapers arcuately to a relatively small, circular flat tip 40. The medial portion 39 of pilot pin 35 is radiused radially inwardly at lead 41 to cylindrical collar portion 36, which is sized for close reception in smaller diameter pilot holes 6 in stock strip 5. As best illustrated in FIG. 18, the medial portion 39 of pilot pin 35 is closely received and retained within the central aperture 13 of pilot sleeve 10, while the arcuate stepped lead 41 adjacent the collar portion 36 is disposed within the interior of pilot sleeve 10 in the assembled condition of FIG. 18. In contrast, the pilot pin 35*a* illustrated in FIGS. 20-23 is a straight pilot and has a relatively blunt tipped, bullet-like profile, wherein the base portion 38*a* is in the shape of an enlarged circular disk, the medial portion 39 is cylindrical, with the outermost end defining the collar portion 36*a* that is sized for close reception in larger diameter pilot holes 6 in stock strip 5. A rolled over arcuate edge leads to the frusto-conical outer portion 37*a*, which has a circular end tip 40*a* which is substantially larger in diameter than the circular end tip 40 of pilot pin 35. As best illustrated in FIG. 22, like pilot pin 35, the medial portion 39*a* of pilot pin 35*a* is closely received within the central aperture 13 of pilot sleeve 10. As noted above, pilot pin 35 is designed to be closely received within a pilot hole 6 that is somewhat smaller in diameter than the pilot hole in which pilot pin 35*a* is received. In any event, it is apparent that a wide variety of differently sized and shaped pilot pins can be assembled in pilot sleeve 10 in accordance with the desires of the die maker and/or die user. The pilot pins 35, 35*a* may be of a conventional, and/or commercially available design, and may even be provided by the die user or die maker themselves, such that they need not be included as part of the purchased pilot assembly 1. The only requirement for any given pilot pin 35 is that the inner end thereof has a diameter that fits closely within the central aperture 13 of one of several differently sized pilot sleeves available.

The illustrated spring member 48 comprises a conventional closed coil spring, which may have partially flattened or ground ends 50, 51 to more securely abut the inner ends 43 of ejector pins 42, as well as the bottom of the die pocket 80 in which the pilot assembly 1 is to be mounted, as described in greater detail hereinafter.

Figure 27:
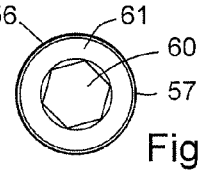
FIG. 27 is a top plan view of a mounting screw portion of the pilot assembly.
Figure 28:
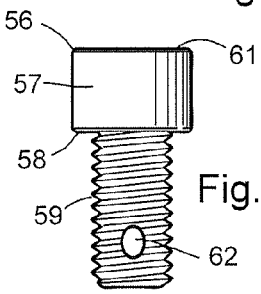
FIG. 28 is a side elevational view of the mounting screw.
Figure 29:
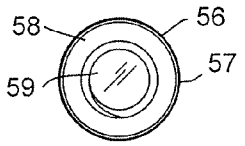
FIG. 29 is a bottom plan view of the mounting screw.

With reference to FIGS. 27-29, the illustrated mounting screw 56 comprises a conventional socket head cap screw having a tool engaging socket 60 in the outer face 61 of the head portion 57 of mounting screw 56, opposite inner face 58, and the threaded shank portion 59 includes a self-locking nylon patch 62, which prevents mounting screw 56 from inadvertently loosening from its tightened condition in die member 3, 4. Mounting screw 56 constitutes a single mounting screw system, configured for at least partial reception in and engagement with any one of the three fastener reliefs 17 in the outer end portion 11 of pilot sleeve 10, which provides the sole support for mounting the pilot sleeve 10, pilot pin 35, ejector pins 42 and spring member 48 in the die member 3, 4, with a compact profile and footprint that facilitates ease of die design, operation and maintenance. The single mounting screw attachment of pilot sleeve 10 and related parts to die member 3 also provides quick and easy installation and removal. As will be appreciated by those skilled in the art, pilot assembly 1 can also be used with a lock washer (not shown) positioned on the shank portion 59 of mounting screw 56.

Figure 32:
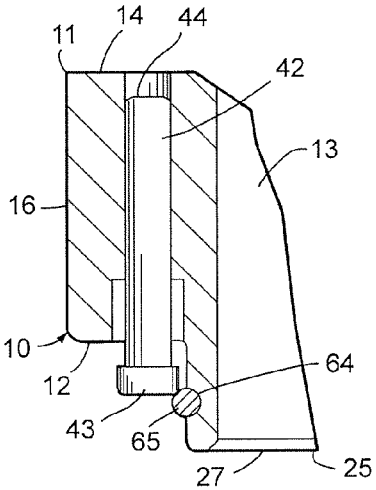
FIG. 32 is an enlarged, fragmentary cross-sectional view of the pilot sleeve, showing the ejector pin and associated retainer ring mounted in place.

The pilot 1 is assembled by inserting four ejector pins 42 into the associated ejector pin holes 20 in the outer end portion 11 of pilot sleeve 10, with the enlarged circular outer ends or heads 50 oriented away from the stock strip 5. Retainer ring 65 is then inserted into the retainer groove 64 adjacent the inner end of spring retainer collar 25, as best shown in FIG. 32, so as to capture each of the ejector pins 42 within the ejector pin apertures 20 of pilot sleeve 10. The spring member 48 is then inserted over the spring retainer collar 25 at the inner end portion 12 of pilot sleeve 10, and into the spring groove 29, such that the outer end 50 of the spring member 48 abuts the inner ends 43 of the ejector pins 42, so as to complete the assembly of pilot 1.

Figure 9:
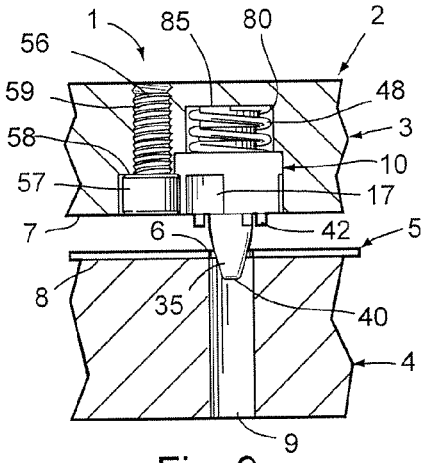
FIG. 9 is a cross-sectional view of the pilot assembly embodying the present invention, shown installed in a die set.
Figure 10:
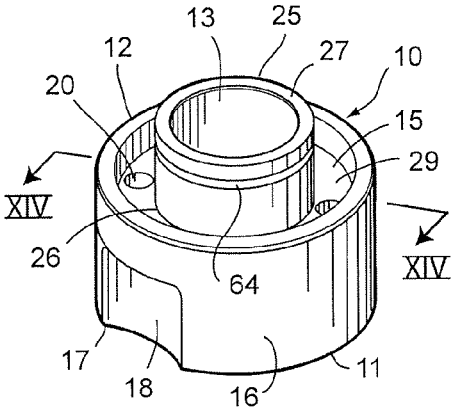
FIG. 10 is a perspective view of a pilot sleeve portion of the pilot assembly, taken from an inner end thereof.
Figure 11:
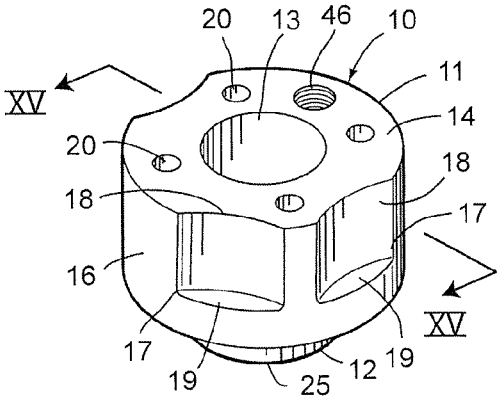
FIG. 11 is a perspective view of the pilot sleeve, taken from an outer end thereof.
Figure 12:
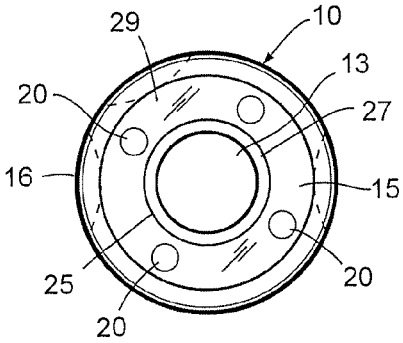
FIG. 12 is a plan view of the inner end of the pilot sleeve.
Figure 36:
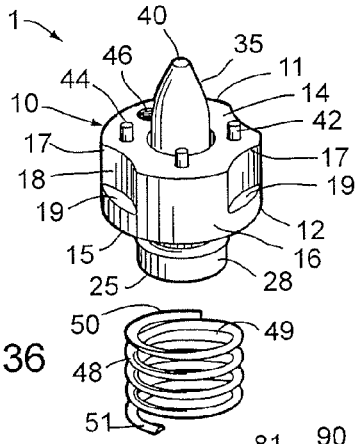
FIG. 36 is an exploded perspective view of the pilot assembly prior to installation into the normally lower mounting face of the machined upper die pressure pad die member shown in FIGS. 34 and 35.
Figure 37:
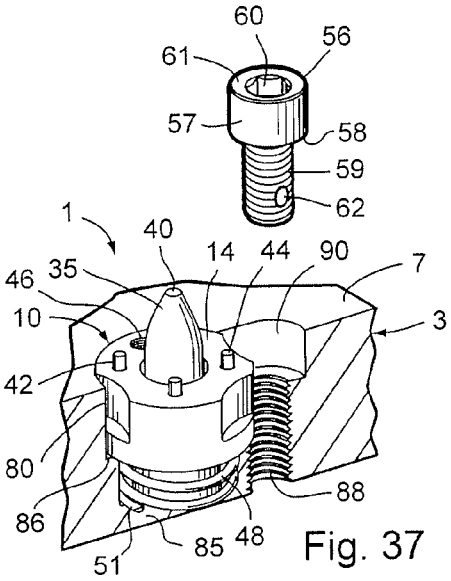
FIG. 37 is an exploded, perspective view of the pilot assembly partially installed in the normally lower mounting face of the upper pressure pad die member shown in FIGS. 34-36.

With reference to FIGS. 34-39, the assembled pilot assembly 1 is quickly and easily installed in the illustrated upper die pad 3 in the following manner. The upper die pad 3 shown in FIGS. 34-38 is illustrated with the normally lower mounting face 7 oriented upwardly in a non-running condition similar to the orientation in which a die maker would install the various tools and/or other components on a particular die half, so as to better visualize the various pilot mounting apertures. However, as is apparent to those skilled in the art, pilot assembly 1 is typically mounted in the lower mounting face 7 of an upper pressure pad 3 or similar die component, and runs or operates in the orientation shown in FIGS. 1, 9, 18-23 and 39. Initially, a non-threaded pilot pocket or blind hole 80 is formed in the lower or mounting face 7 of the upper die pad 3 using simple machining techniques and no special tooling, and is shaped to closely receive and retain the pilot sleeve 10 therein. The illustrated pilot pocket 80 has a stepped construction, with a larger diameter aperture 81 defined by sidewall 82 disposed closest to stock strip 5 and lower die mounting surface 7, and a smaller diameter aperture 83 defined by sidewall 84 and circular bottom wall or base 85, disposed furthest away from the stock strip 5 and lower die mounting surface 7, with an annular lip or collar 86 formed therebetween. The outer sidewall 16 of the outer end portion 11 of pilot sleeve 10 fits closely within the larger aperture 81 of the pilot pocket 80, and the recessed inner end 15 of the outer end portion 11 of pilot sleeve 10 engages lip 86 to axially locate the assembled pilot sleeve 10 within pilot pocket 80. The circularly shaped bottom wall or base 85 defines the closed end of the smaller aperture 82 portion of pilot pocket 80, which with sidewall 84, provides a cup-shaped portion 86 of pilot pocket 80. In the orientation illustrated in FIGS. 34-38, bottom wall 85 faces upwardly. The spring retainer collar 25 of pilot sleeve 10, along with the spring member 48 and retainer ring 65 are captured in the cup-shaped portion 86 of pilot pocket 80. The depth or vertical dimension of the cup-shaped portion 86 of pilot pocket 80 is less than the length of spring member 48, as measured between its opposite ends 50, 51 in the relaxed condition shown in FIG. 2. Consequently, when the assembled pilot 1 is inserted into the pilot pocket 80, the inner end 51 of spring member 58 contacts the end wall 85 of pilot pocket 80, and spring member 48 is pretensed to a predetermined biasing force sufficient to resiliently urge ejector pins 42 toward their normally extended position, as shown in FIGS. 37-38. Furthermore, in the installed condition shown in FIGS. 37-39, the flat bottom surface 45 of pilot pin 35 abuts flush against the bottom wall or base 85 of the cup-shaped portion 86 of pilot pocket 80 to securely locate pilot pin 35 vertically or axially, in the manner shown in FIGS. 1 and 37-39. A single, threaded mounted screw aperture 88 is formed in the lower or mounting face 7 of die pressure pad 3 at a location spaced laterally apart a predetermined distance from the pilot pocket 80, and is shaped to closely receive therein the shank portion 59 of mounting screw 56. It is noteworthy that screw aperture 38 can be located at several different positions on the mounting face 7 of die member 3 to avoid interference with other die components that may be mounted thereon, so long as mounting screw 56 can be aligned with one of the three fastener reliefs 17 in the outer end portion 11 of pilot sleeve 10, as shown in FIGS. 34-39. A lateral pocket 90 having a generally U-shaped plan configuration is formed between and connects the threaded screw hole 85 and the larger pilot aperture 81 of pilot pocket 80 along the lower mounting face 7 of upper pressure pad 3, and is sized to receive a portion of mounting screw 56 therein. As will be appreciated by those skilled in the art, assembled pilot 1 can also be installed in an upper pressure pad 3 or other die component machined as outlined above, with the pressure pad 3 and any other related die components oriented in the run condition shown in FIGS. 1, 9 and 39.

The assembled pilot 1 is then aligned with and inserted into the pressure pad 3 in the manner illustrated in FIGS. 36 and 37. The pilot sleeve 10 is rotated in pilot pocket 80, so that one of the three fastener reliefs 17 in the outer end portion 11 of pilot sleeve 10 is laterally aligned with the threaded screw aperture 88 in the mounting face 6 of die member 3. Mounting screw 56 is then inserted into the threaded retainer aperture 88 in the upper die pad member 3. The tightening of mounting screw 56 in the mounting screw aperture 88 in the die member 3 abuttingly engages at least a portion of the innerface 58 on the head portion 57 of mounting screw 56 against the relief end surface 19 on the outer end portion 11 of pilot sleeve 10 to securely, yet detachably mount the pilot assembly on the die member, and simultaneously compress spring member 48 to the predetermined biasing force, and draws the bottom surface 45 of pilot pin 35 abuttingly against the bottom wall or base 85 of pilot pocket 80. Consequently, ejector pins 42 automatically reciprocate between the retracted and extended positions, relative to the pilot sleeve 10 during operation of the metal forming die to insure that the stock strip 5 is consistently and fully stripped away from the pilot pin 35. As will be appreciated by those skilled in the art, under special and/or abnormal conditions, multiple mounting screws 50 may be used to secure pilot 10 in die member 3. Essentially, the fully cylindrical areas of the outer end portion 11 of pilot sleeve 10, when closely received in the larger diameter portion 81 of pilot pocket 80, precisely locate and support the pilot assembly in the die work station, and the single mounting screw 56 securely, yet detachably retains the assembled pilot in the set, aligned condition, in the pilot pocket 80.

The pilot sleeve and related pilot assembly 1 may be readily removed from die member 3 by simply reversing the sequence of the installation steps described above. In the illustrated example, a puller tool 68 (FIG. 38) is provided to facilitate safe removal and handling of the pilot 10. More specifically, puller tool 68 has a threaded outer end 66*a* that is threadedly engaged in the threaded aperture 46 in pilot sleeve 10, and a weighted sliding handle 68 which is manually shifted outwardly along the rod shaped body of puller tool 68 to impact an enlarged head 68*c*, thereby imparting sufficient outwardly directed forces to easily extract pilot sleeve 10 from the pilot hole 80 in die member 3. Alternatively, pilot sleeve 10 can be removed from die member 3 by tapping it out of pilot hole 80 with a punch and hammer applied from the outer end of pilot sleeve 10.

Figure 39:
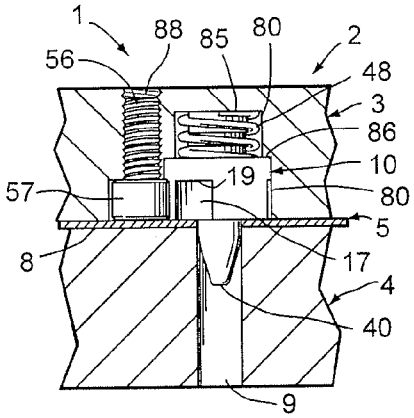
FIG. 39 is a vertical cross-sectional view of the pilot assembly, shown installed in the upper pressure pad die member of FIGS. 34-38, oriented in the running condition, with the pilot pin fully inserted into the pilot aperture in the stock strip.

FIGS. 1 and 39 illustrate the operation of pilot assembly 1, wherein FIG. 1 illustrates the upper pressure pad 3 with pilot assembly 1 mounted therein converging against the stock strip 5 that is supported on the upper surface 8 of the lower die member 4. In this position, the ejector pins 42 are fully extended, and just start to abut against the upper surface of the stock strip 5. The frusto-conical portion 37 of the pilot pin 35 is received through the most closely aligned one of the pilot holes 6 in stock strip 5 and into the female pilot pad portion 9 in the bottom or lower die member 4, but the collar portion 36 of pilot pin 35 is not. Next, the upper die pad 3 converges or closes completely against the stock strip 5 and lower die member 4 supporting the same in the manner illustrated in FIG. 39, such that the abutting contact between the outer ends 44 of the ejector pins 42 and the upper surface of the stock strip 5 overcome the biasing force of pretensed spring member 48 on ejector pins 42, further compresses spring member 48, and shifts or retracts the ejector pins 42 back toward the interior of the outer end portion 11 of pilot sleeve 10. As shown in FIG. 39, the collar portion 36 of the pilot pin 35 is now fully received in the aligned pilot hole 6 in stock strip 5 and the female pilot portion 9 in the bottom die member 4. The metal forming operation in the associated die work station 12 is then completed with the pilot assembly 1 in the position shown in FIG. 39, such that the stock strip 5 is precisely located and securely held in place during formation and further processing of stock strip 5. As the upper die pad 3 diverges or moves away from the stock strip 5 and the lower die member 4, the resilient force generated by spring member 48, urges the ejector pins 42 back outwardly toward and abuttingly against the stock strip 5 and separates or strips the stock strip 5 from the pilot pin 35, such that the stock strip 5 can then be quickly shifted longitudinally to the next work station 12 for further processing.

As will be appreciated by those skilled in the art, pilot assembly 1 can be provided in a wide variety of different sizes to accommodate many different metal forming die applications. The all-in-one, modular construction of pilot assembly 1 not only provides a self-contained stock stripper that uses only one spring, but can be quickly and easily installed directly in a die member using simple machining techniques, and a single mounting screw.

Pilot assembly 1 has an uncomplicated construction with relatively few components and is therefore quite durable and economical to manufacture. The single mounting screw attachment of the pilot assembly to an associated die member provides quick and easy installation and removal. The spring member 48 and pilot pin 35 are backed up or axially supported by the die member itself for greater strength and convenience. Pilot assembly 1 has a self-contained stripper which positively separates the stock strip from the pilot during operation of the metal forming die, and provides a very compact, low profile shape that can be used at various locations and orientations on the various die members. The installation of the pilot assembly 1 can be achieved with simple machining, so as to reduce installation time and cost. The pilot sleeve portion 10 of the pilot assembly 1 is configured to receive and retain a wide variety of differently sized and shaped pilot pins therein, partially those with a conventional and/or commercially available configuration, so as to accommodate many different applications and users.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. In a multi-station progressive metal forming die having at least two mutually converging and diverging die members between which an elongate stock strip is shifted longitudinally to form parts from the stock strip, the improvement of a modular pilot assembly with self-contained stripper for precisely locating the stock strip in the die stations, comprising:

a pilot sleeve operably supported on one of said die members and having a generally cylindrical shape with an outer end portion oriented toward the stock strip, an oppositely disposed inner end portion oriented away from the stock strip, and a central aperture extending through said outer and inner end portions, and wherein;

said outer end portion of said pilot sleeve has a generally flat outer end oriented toward the stock strip, a generally recessed inner end oriented away from the stock strip, and an outer sidewall with a least one fastener relief therein having an arcuately shaped, radially inwardly curved relief sidewall that extends axially from said flat outer end to a generally flat arcuately shaped relief end surface facing toward the stock strip and spaced axially outwardly a predetermined distance from said recessed inner end, as well as at least one axially extending ejector pin aperture which opens through said flat outer end and into said recessed inner end; and said inner end portion of the pilot sleeve has a generally annularly shaped spring retainer collar, with an outer end oriented toward the stock strip, an inner end oriented away from the stock strip, and an outer sidewall with a diameter that is less than the diameter of said outer sidewall of said outer end portion of said pilot sleeve, thereby forming an annularly shaped spring groove adjacent said outer end of said spring retainer collar;

a rigid pilot pin having at least a portion thereof shaped for close reception in said central aperture of said pilot sleeve in an assembled condition, and including a circularly shaped innermost collar portion disposed adjacent said flat outer end of said pilot sleeve when in said assembled condition and shaped for close reception in a pilot hole in the stock strip, a generally frusto-conically shaped outer portion configured to engage the pilot hole in the stock strip and guide the stock strip to a predetermined position in an associated die forming station, and a base portion positioned opposite said frusto-conically shaped outer portion;

at least one rigid ejector pin slidingly received and retained in said ejector pin aperture in said outer end portion of said pilot sleeve, having an inner end oriented away from the stock strip and an outer end oriented toward the stock strip and protruding outwardly from said flat outer end of said outer end portion of said pilot sleeve when urged to an extended position to contact the stock strip and strip the same away from said pilot pin, and retracts toward said pilot sleeve when urged to a retracted position;

a spring member having a generally hollow interior that is received onto and over said spring retainer collar on said inner end portion of said pilot sleeve, an outer end oriented toward the stock strip, received in said spring groove and operably engaging said inner end of said ejector pin to bias said ejector pin outwardly to said extended position, and an inner end oriented away from the stock strip and positioned adjacent to said base portion of said pilot pin in said assembled condition; and a mounting screw having an enlarged head portion with a circular plan shape that is at least partially, closely received in said fastener relief in said outer end portion of said pilot sleeve, an annularly shaped inner face oriented away from the stock strip and abuttingly engaging said relief end surface of said fastener relief in said outer end portion of said pilot sleeve, and a threaded shank portion anchored in said one die member to securely, yet detachably mount said pilot assembly on said one die member in a manner which causes said ejector pin to automatically reciprocate between said retracted and extended positions relative to said pilot sleeve during operation of said metal forming die to insure that the stock strip is consistently stripped away from said pilot pin.

2. A metal forming die as set forth in claim 1, wherein:

said spring retainer collar includes a retainer groove disposed adjacent said inner end of said spring retainer collar, and including a retainer ring detachably retained in said retainer groove in said spring retainer collar and selectively abutting said inner end of said ejector pin to retain the same within said pilot sleeve.

3. A metal forming die as set forth in claim 2, wherein:

said pilot pin comprises one of a variety of differently shaped, commercially available pilot pins, each configured for close reception and secure retention in said central aperture of said pilot sleeve.

4. A metal forming die as set forth in claim 3, wherein:

said first die member includes a blind hole pocket in which said pilot sleeve is received having a cylindrical sidewall and flat base, with said outer sidewall of said outer portion of said pilot sleeve closely received within said sidewall of said blind hole pocket, and said base portion of said pilot pin and said inner end of said spring member abuttingly supported on said base of said blind hole, whereby said ejector pin reciprocates between said extended and retracted positions relative to said pilot sleeve during operation of said metal forming die.

5. A metal forming die as set forth in claim 4, wherein:

said outer end portion of said pilot sleeve includes a plurality of said fastener reliefs having a substantially identical configuration and arranged in a circumferentially spaced apart pattern around said outer sidewall to facilitate mounting said pilot assembly at various locations and orientations on said one die member.

6. A metal forming die as set forth in claim 5, wherein:

said mounting screw comprises a single mounting screw configured for at least partial reception in and engagement with any one of said fastener reliefs in said outer end portion of said pilot sleeve, which provides the sole support for mounting said pilot sleeve in said one die member, with a compact footprint that facilitates ease of die design and pilot installation.

7. A metal forming die as set forth in claim 6, wherein:

said pilot sleeve has a one-piece construction formed from a solid bar of rigid material.

8. A metal forming die as set forth in claim 7, wherein:

said outer end portion of said pilot sleeve includes a plurality of said ejector pin apertures having a substantially identical configuration and arranged in a circumferentially spaced apart, mutually parallel, axially extending pattern through said outer end portion to insure effective stripping of the stock strip from said pilot pin; and including a plurality of said ejector pins having a substantially identical configuration and slidingly received and retained in said ejector pin apertures in said outer end portion of said pilot sleeve.

9. A metal forming die as set forth in claim 8, wherein:

said outer ends of said ejector pins selectively project from said ejector pin apertures in said outer end portion of said pilot sleeve at locations immediately adjacent said central aperture in said pilot sleeve to insure effective stripping of the stock strip from said pilot pin.

10. A metal forming die as set forth in claim 9, wherein:

said blind hole pocket is formed in a mounting face of said one die member, wherein said outer sidewall thereof has a first axial portion oriented toward the stock strip in which said outer sidewall of said outer end portion of said pilot sleeve is closely received to accurately locate said pilot assembly on said one die member, and a second axial portion oriented away from the stock strip in which said inner end portion of said pilot sleeve and said spring member are received.

11. A metal forming die as set forth in claim 10, wherein:

said mounting face of said one die member includes a threaded mounting screw aperture therein spaced laterally from said pilot pocket a predetermined distance in which said mounting screw is anchored.

12. A metal forming die as set forth in claim 11, wherein:

said mounting screw comprises a cap screw.

13. A metal forming die as set forth in claim 12, wherein:

said one die member comprises a reciprocating die pad.

14. A metal forming die as set forth in claim 13, wherein:

said pilot sleeve and said pilot pin are arranged in a generally concentric relationship.

15. A metal forming die as set forth in claim 1, wherein:

said pilot pin comprises one of a variety of differently shaped, commercially available pilot pins, each configured for close and secure reception in said central aperture of said pilot sleeve.

16. A metal forming die as set forth in claim 1, wherein:

said first die member includes a blind hole pocket in which said pilot sleeve is received having a cylindrical sidewall and flat base, with said outer sidewall of said outer portion of said pilot sleeve closely received in said sidewall of said blind hole pocket, and said base portion of said pilot pin and said inner end of said spring member abuttingly supported on said base of said blind hole, whereby said ejector pin reciprocates between said extended and retracted positions relative to said pilot sleeve during operation of said metal forming die.

17. A metal forming die as set forth in claim 1, wherein:

said outer end portion of said pilot sleeve includes a plurality of said fastener reliefs having a substantially identical configuration and arranged in a circumferentially spaced apart pattern around said outer sidewall to facilitate mounting said pilot assembly at various locations and orientation on said one die member.

18. A metal forming die as set forth in claim 1, wherein:

said mounting screw comprises a single mounting screw configured for at least partial reception in and engagement with any one of said fastener reliefs in said outer end portion of said pilot sleeve, which provides the sole support for mounting said pilot sleeve in said one die member, with a compact footprint that facilitates ease of die design and pilot installation.

19. A metal forming die as set forth in claim 1, wherein:

said outer end portion of said pilot sleeve includes a plurality of said ejector pin apertures having a substantially identical configuration and arranged in a circumferentially spaced apart, mutually parallel, axially extending pattern through said outer end portion to insure effective stripping of the stock strip from said pilot pin; and including a plurality of said ejector pins having a substantially identical configuration and slidingly received and retained in said ejector pin apertures in said outer end portion of said pilot sleeve.

20. A modular pilot assembly with self-contained stripper for multi-station progressive metal forming dies having at least two mutually converging and diverging die members between which an elongate stock strip is shifted longitudinally to form parts from the stock strip, comprising:

a pilot sleeve configured for operable support on an associated die member, and having a generally cylindrical shape with an outer end portion oriented toward the stock strip, an oppositely disposed inner end portion oriented away from the stock strip, and a central aperture extending through said outer and inner end portions, and wherein;

said outer end portion of said pilot sleeve has a generally flat outer end oriented toward the stock strip, a generally recessed inner end oriented away from the stock strip, and an outer sidewall with a least one fastener relief therein having an arcuately shaped, radially inwardly curved relief sidewall that extends axially from said flat outer end face to a generally flat arcuately shaped relief end surface facing toward the stock strip and spaced axially outwardly a predetermined distance from said recessed inner end, as well as at least one axially extending ejector pin aperture which opens through said flat outer end and into said recessed inner end; and said inner end portion of the pilot sleeve has a generally annularly shaped spring retainer collar, with an outer end oriented toward the stock strip, an inner end oriented away from the stock strip, and an outer sidewall with a diameter that is less than the diameter of said outer sidewall of said outer end portion of said pilot sleeve, thereby forming an annularly shaped spring groove adjacent said outer end of said spring retainer collar;

a rigid pilot pin having at least a portion thereof shaped for close reception in said central aperture of said pilot sleeve in an assembled condition, and including a circularly shaped innermost collar portion disposed adjacent said flat outer end of said pilot sleeve when in said assembled condition and shaped for close reception in a pilot hole in the stock strip, a generally frusto-conically shaped outer portion configured to engage the pilot hole in the stock strip and guide the stock strip to a predetermined position in an associated die forming station, and a base portion positioned opposite said frusto-conically shaped outer portion;

at least one rigid ejector pin slidingly received and retained in said ejector pin aperture in said outer end portion of said pilot sleeve, having an inner end oriented away from the stock strip and an outer end oriented toward the stock strip and protruding outwardly from said flat outer end of said outer end portion of said pilot sleeve when urged to an extended position to contact the stock strip and strip the same away from said pilot pin, and retracts toward said outer end portion of said pilot sleeve when urged to a retracted position;

a spring member having a generally hollow interior that is received onto and over said spring retainer collar on said inner end portion of said pilot sleeve, an outer end oriented toward the stock strip, received in said spring groove and operably engaging said inner end of said ejector pin to bias said ejector pin outwardly to said extended position, and an inner end oriented away from the stock strip and positioned adjacent to said base portion of said pilot pin in said assembled condition; and a mounting screw having an enlarged head portion with a circular plan shape that is at least partially, closely received in said fastener relief in said outer end portion of said pilot sleeve, an annularly shaped inner face oriented away from the stock strip and abuttingly engaging said relief end surface of said fastener relief in said outer end portion of said pilot sleeve, and a threaded shank portion shaped for anchoring in the associated die member to securely, yet detachably mount said pilot assembly on the associated die member in a manner which causes said ejector pin to automatically reciprocate between said retracted and extended positions relative to said pilot sleeve during operation of the metal forming die to insure that the stock strip is consistently stripped away from said pilot pin.

21. A modular pilot assembly as set forth in claim 20, wherein:

said spring retainer collar includes a retainer groove disposed adjacent said inner end of said spring retainer collar, and including a retainer ring detachably retained in said retainer groove in said spring retainer collar and selectively abutting said inner end of said ejector pin to retain the same within said pilot sleeve.

22. A modular pilot assembly as set forth in claim 21, wherein:

said pilot pin comprises one of a variety of differently shaped, commercially available pilot pins, each configured for close and secure reception in said central aperture of said pilot sleeve.

23. A modular pilot assembly as set forth in claim 22, wherein:

said outer sidewall of said outer portion of said pilot sleeve is shaped to be closely received in a cylindrical portion of a blind hole pocket in the associated die member, with said base portion of said pilot pin and said inner end of said spring member abuttingly supported on a base portion of the blind hole pocket, whereby said ejector pin reciprocates between said extended and retracted positions relative to said pilot sleeve during operation of the metal forming die.

24. A modular pilot assembly as set forth in claim 23, wherein:

said outer end portion of said pilot sleeve includes a plurality of said fastener reliefs having a substantially identical configuration and arranged in a circumferentially spaced apart pattern around said outer sidewall to facilitate mounting said pilot assembly at various locations and orientation on the associated die member.

25. A modular pilot assembly as set forth in claim 24, wherein:

said mounting screw comprises a single mounting screw configured for at least partial reception in and engagement with any one of said fastener reliefs in said outer end portion of said pilot sleeve, which provides the sole support for mounting said pilot sleeve in the associated die member, with a compact footprint that facilitates ease of die design and pilot installation.

26. A modular pilot assembly as set forth in claim 25, wherein:

said pilot sleeve has a one-piece construction formed from a solid bar of rigid material.

27. A modular pilot assembly as set forth in claim 26, wherein:

said outer end portion of said pilot sleeve includes a plurality of said ejector pin apertures having a substantially identical configuration and arranged in a circumferentially spaced apart, mutually parallel, axially extending pattern through said outer end portion to insure effective stripping of the stock strip from said pilot pin; and including a plurality of said ejector pins having a substantially identical configuration and slidingly received and retained in said ejector pin apertures in said outer end portion of said pilot sleeve.

28. A modular pilot assembly as set forth in claim 27, wherein:

said outer ends of said ejector pins selectively project from said ejector pin apertures in said outer end portion of said pilot sleeve at locations immediately adjacent said central aperture in said pilot sleeve to insure effective stripping of the stock strip from said pilot pin.

29. A modular pilot assembly as set forth in claim 28, wherein:

said pilot sleeve and said pilot pin are arranged in a generally concentric relationship.

30. A modular pilot assembly with self-contained stripper for multi-station progressive metal forming dies having at least two mutually converging and diverging die members between which an elongate stock strip is shifted longitudinally to form parts from the stock strip, and at least one pilot pin to precisely locate the stock strip in the die stations, comprising:

a pilot sleeve configured for operable support on an associated die member, and having a generally cylindrical shape with an outer end portion oriented toward the stock strip, an oppositely disposed inner end portion oriented away from the stock strip, and a central aperture extending through said outer and inner end portions shaped to closely receive and selectively retain the pilot pin therein, and wherein;

said outer end portion of said pilot sleeve has a generally flat outer end oriented toward the stock strip, a generally recessed inner end oriented away from the stock strip, and an outer sidewall with a least one fastener relief therein having an arcuately shaped, radially inwardly curved relief sidewall that extends axially from said flat outer end face to a generally flat arcuately shaped relief end surface facing toward the stock strip and spaced axially outwardly a predetermined distance from said recessed inner end, as well as at least one axially extending ejector pin aperture which opens through said flat outer end and into said recessed inner end; and said inner end portion of the pilot sleeve has a generally annularly shaped spring retainer collar, with an outer end oriented toward the stock strip, an inner end oriented away from the stock strip, and an outer sidewall with a diameter that is less than the diameter of said outer sidewall of said outer end portion of said pilot sleeve, thereby forming an annularly shaped spring groove adjacent said outer end of said spring retainer collar;

at least one rigid ejector pin slidingly received and retained in said ejector pin aperture in said outer end portion of said pilot sleeve, having an inner end oriented away from the stock strip and an outer end oriented toward the stock strip and protruding outwardly from said flat outer end of said outer end portion of said pilot sleeve when urged to an extended position to contact the stock strip and strip the same away from the pilot pin, and retracts toward said pilot sleeve when urged to a retracted position;

a spring member having a generally hollow interior that is received onto and over said spring retainer collar on said inner end portion of said pilot sleeve, an outer end oriented toward the stock strip, received in said spring groove and operably engaging said inner end of said ejector pin to bias said ejector pin outwardly to said extended position, and an inner end oriented away from the stock strip and positioned adjacent to said inner end of said spring retainer collar in said assembled condition; and a mounting screw having an enlarged head portion with a circular plan shape that is at least partially, closely received in said fastener relief in said outer end portion of said pilot sleeve, an annularly shaped inner face oriented away from the stock strip and abuttingly engaging said relief end surface of said fastener relief in said outer end portion of said pilot sleeve, and a threaded shank portion shaped for anchoring in the associated die member to securely, yet detachably mount said pilot assembly on the associated die member in a manner which causes said ejector pin to automatically reciprocate between said retracted and extended positions relative to said pilot sleeve during operation of the metal forming die to insure that the stock strip is consistently stripped away from the pilot pin.

31. A modular pilot assembly as set forth in claim 30, wherein:

said spring retainer collar includes a retainer groove disposed adjacent said inner end of said spring retainer collar, and including a retainer ring detachably retained in said retainer groove in said spring retainer collar and selectively abutting said inner end of said ejector pin to retain the same within said pilot sleeve.

32. A modular pilot assembly as set forth in claim 31, wherein: further including a pilot pocket configure to securely, yet detachably support therein one of a variety of differently shaped pilot pins.

33. A modular pilot assembly as set forth in claim 32, wherein:

said outer sidewall of said outer portion of said pilot sleeve is shaped to be closely received in a cylindrical portion of a blind hole pocket in the associated die member, with said inner end of said spring member abuttingly supported on a base portion of the blind hole pocket, whereby said ejector pin reciprocates between said extended and retracted positions relative to said pilot sleeve during operation of the metal forming die.

34. A modular pilot assembly as set forth in claim 33, wherein:

said outer end portion of said pilot sleeve includes a plurality of said fastener reliefs having a substantially identical configuration and arranged in a circumferentially spaced apart pattern around said outer sidewall to facilitate mounting said pilot assembly at various locations and orientation on the associated die member.

35. A modular pilot assembly as set forth in claim 34, wherein:

said mounting screw comprises a single mounting screw configured for at least partial reception in and engagement with any one of said fastener reliefs in said outer end portion of said pilot sleeve, which provides the sole support for mounting said pilot sleeve in the associated die member, with a compact footprint that facilitates ease of die design and pilot installation.

36. A modular pilot assembly as set forth in claim 35, wherein:

said pilot sleeve has a one-piece construction formed from a solid bar of rigid material.

37. A modular pilot assembly as set forth in claim 36, wherein:

said outer end portion of said pilot sleeve includes a plurality of said ejector pin apertures having a substantially identical configuration and arranged in a circumferentially spaced apart, mutually parallel, axially extending pattern through said outer end portion to insure effective stripping of the stock strip from said pilot pin; and including a plurality of said ejector pins having a substantially identical configuration and slidingly received and retained in said ejector pin apertures in said outer end portion of said pilot sleeve.

38. A modular pilot assembly as set forth in claim 37, wherein:

said outer ends of said ejector pins selectively project from said ejector pin apertures in said outer end portion of said pilot sleeve at locations immediately adjacent said central aperture in said pilot sleeve to insure effective stripping of the stock strip from said pilot pin.

39. A modular pilot assembly as set forth in claim 38, wherein:

said central aperture in said pilot sleeve is provided in a plurality of different sizes to receive therein a variety of customer provided pilot pins.

* * * * *